US010201221B1

(12) United States Patent
Chang et al.

(10) Patent No.: US 10,201,221 B1
(45) Date of Patent: Feb. 12, 2019

(54) HAND STRAP

(71) Applicant: Getac Technology Corporation, Hsinchu County (TW)

(72) Inventors: Chia-Wei Chang, Taipei (TW); Shi-Liang Zhong, Taipei (TW)

(73) Assignee: GETAC TECHNOLOGY CORPORATION, Hsinchu County (TW)

( * ) Notice: Subject to any disclaimer, the term of this patent is extended or adjusted under 35 U.S.C. 154(b) by 0 days.

(21) Appl. No.: 15/790,396

(22) Filed: Oct. 23, 2017

(51) Int. Cl.
*A45F 4/02* (2006.01)
*A45F 5/10* (2006.01)

(52) U.S. Cl.
CPC ..... *A45F 5/10* (2013.01); *A45F 2005/1006* (2013.01)

(58) Field of Classification Search
CPC ..... A45F 4/02; A45F 2004/023
USPC ..... 224/577, 578
See application file for complete search history.

(56) References Cited

U.S. PATENT DOCUMENTS 5,412,545 A * 5/1995 Rising ..... A42B 1/244 2/209.13
6,360,928 B1 * 3/2002 Russo ..... A45F 5/00 224/218
7,296,752 B2 * 11/2007 Carnevali ..... G06F 1/163 235/462.43
8,604,931 B1 * 12/2013 Veloso ..... H04M 1/72577 340/5.31
8,616,423 B2 * 12/2013 Wizikowski ..... A45F 5/00 224/218
8,690,210 B1 * 4/2014 May ..... A45F 5/00 224/217
8,960,634 B2 * 2/2015 Le Gette ..... F16M 11/04 248/163.1
9,074,725 B2 * 7/2015 Trotsky ..... F16M 11/043
2004/0233631 A1 * 11/2004 Lord ..... G06F 1/1632 361/679.41
2008/0156836 A1 * 7/2008 Wadsworth ..... A45C 11/00 224/269
2009/0219677 A1 * 9/2009 Mori ..... A45F 3/14 361/679.03

(Continued)

FOREIGN PATENT DOCUMENTS

CN 102202478 A 9/2011
TW 201228522 A 7/2012
TW 201721336 A 6/2017

OTHER PUBLICATIONS

Taiwan Intellectual Property Office, Office Action, dated Aug. 23, 2018, Taiwan.

*Primary Examiner* — Brian D Nash
(74) *Attorney, Agent, or Firm* — Locke Lord LLP; Tim Tingkang Xia, Esq.

(57) ABSTRACT

A hand strap for a portable electronic device is disclosed, wherein the hand strap comprises a fastened portion, a supporting portion and a holding portion. The fastened portion is fixed on a rear surface of the portable electronic device. The supporting portion has a first support body and a second support body. The second support body is rotatable to pivot on the fastened portion in accordance with an axis which is perpendicular to the rear surface of the portable electronic device. In a folded state, the first support body and the second support body are attached to each other. In an extended state, the first support body is inclined an angle corresponding to the second support body so as to support the portable electronic device.

12 Claims, 7 Drawing Sheets

(56) References Cited

U.S. PATENT DOCUMENTS

2009/0321483 A1* 12/2009 Froloff ..... A45F 5/00 224/267
2011/0267748 A1* 11/2011 Lane ..... A45F 5/00 361/679.01
2011/0278885 A1* 11/2011 Procter ..... B60R 11/0235 297/135
2011/0279959 A1* 11/2011 Lopez ..... A45F 5/00 361/679.03
2011/0299231 A1* 12/2011 Gaddis, II ..... H05K 5/023 361/679.01
2012/0104185 A1* 5/2012 Carroll ..... F16M 11/041 248/27.1
2012/0113572 A1* 5/2012 Gaddis, II ..... G06F 1/1628 361/679.01
2013/0134267 A1* 5/2013 Liu ..... F16M 11/10 248/122.1
2013/0293072 A1* 11/2013 Sturniolo ..... H05K 5/0004 312/138.1
2013/0295549 A1* 11/2013 Hills ..... G09B 7/00 434/379
2014/0187297 A1* 7/2014 Chang ..... H04M 1/21 455/575.8
2014/0361057 A1* 12/2014 Gardner ..... A45F 5/00 224/222
2015/0041244 A1* 2/2015 Kam ..... A45C 11/00 181/191
2015/0173497 A1* 6/2015 Yu ..... A45F 5/00 224/218
2015/0175309 A1* 6/2015 McGowan ..... B65D 25/2882 224/191
2015/0318885 A1* 11/2015 Earle ..... H04B 1/385 455/575.6
2016/0028428 A1* 1/2016 Sturniolo ..... H04B 1/3888 455/575.8

* cited by examiner

HAND STRAP

BACKGROUND OF THE INVENTION

Field of the Invention

The present invention relates to hand straps and, more particularly, to a hand strap which serves a supporting purpose and is applicable to a portable electronic device.

Description of the Prior Art

With proliferation of portable electronic devices, such as cellular phones and tablets, it is necessary for various conventional hand straps and conventional supports to be developed in order to meet user needs. For instance, a conventional hand strap is disposed on the rear surface of a portable electronic device, and thus a user can hold the portable electronic device easily by gripping the hand strap. In another scenario, a portable electronic device is erected when supported by a conventional support, and thus a user can put the portable electronic device on a desk or any working surface in order to operate the portable electronic device conveniently.

As the functionality of the aforesaid conventional hand strap and conventional support is restricted to gripping and supporting a portable electronic device, respectively, users must not only own both of them but also alternate between them as needed. As a result, the laborious swaps never stop but require space for keeping the one not in use.

In view of the aforesaid drawbacks of the prior art, it is necessary to provide a hand strap with an additional supportive function.

SUMMARY OF THE INVENTION

The present invention provides a hand strap for use with a portable electronic device. The hand strap is disposed on a rear surface of the portable electronic device. In a folded state, a user directly grips the hand strap and rotates the portable electronic device relative to the hand strap by an angle at which the portable electronic device can be operated most conveniently. After the hand strap has been unfolded, the hand strap, now in an unfolded state, supports the portable electronic device so that the portable electronic device is upright and stands on any desktop or working surface.

The hand strap of the present invention is for use with a portable electronic device. The hand strap comprises a fastening portion, a supporting portion and a gripping portion. The fastening portion is fastened to a rear surface of the portable electronic device. The supporting portion has a first supporting element and a second supporting element. The second supporting element is rotatably pivotally connected to the fastening portion about an axis perpendicular to the rear surface. An end of the first supporting element is connected to an end of the second supporting element. The gripping portion is disposed on the first supporting element. The first supporting element and the second supporting element overlap in a folded state, and the first supporting element tilts relative to the second supporting element by an angle in an unfolded state, thereby allowing the supporting portion to support the portable electronic device.

The supporting portion further has a positioning element connected between the first supporting element and the second supporting element. The positioning element is retractedly positioned between the first supporting element and the second supporting element in the folded state and extendedly connected between the first supporting element and the second supporting element in the unfolded state, thereby allowing the first supporting element to tilt relative to the second supporting element by the angle.

The first supporting element has a first engaging structure, and the second supporting element has a second engaging structure. In the folded state, the first engaging structure and the second engaging structure are coupled together. In the unfolded state, the second engaging structure and the first engaging structure separate.

The fastening portion has a central connecting element and connecting cords. The connecting cords are each extended from the central connecting element and fastened to the rear surface of the portable electronic device. The second supporting element is pivotally connected to the central connecting element.

The gripping portion has an elastic adjustable band and a ring. After penetrating the ring, the elastic adjustable band is divided into a first portion and a second portion. The first portion and the second portion adjoin each other. The ring adjusts the lengths of the first portion and the second portion. The first portion and the first supporting element jointly define a hand receiving space.

The central connecting element, the first supporting element, and the second supporting element are each a plate. In the folded state, the central connecting element, the first supporting element, the second supporting element, and the rear surface are parallel.

In an embodiment of the present invention, the hand strap further comprises a pen case disposed beside the first supporting element.

In an embodiment of the present invention, the first engaging structure and the second engaging structure are each a fastener whereby in the folded state the first engaging structure and the second engaging structure are fastened to each other. The connecting cords are extended from two ends of the central connecting element and fastened to the portable electronic device.

In another embodiment of the present invention, the first engaging structure is disposed at another end of the first supporting element, whereas the second engaging structure extends from another end of the second supporting element. In the folded state, the second engaging structure covers the another end of the first supporting element to engage with the first engaging structure. In the unfolded state, the second engaging structure is disposed below the positioning element. The connecting cords are extended from four corners of the central connecting element and fastened to the portable electronic device.

The aforesaid objectives, technical features, and advantages of the present invention are hereunder illustrated with preferred embodiments in conjunction with the accompanying drawings.

DETAILED DESCRIPTION OF THE EMBODIMENTS

Figure 1:
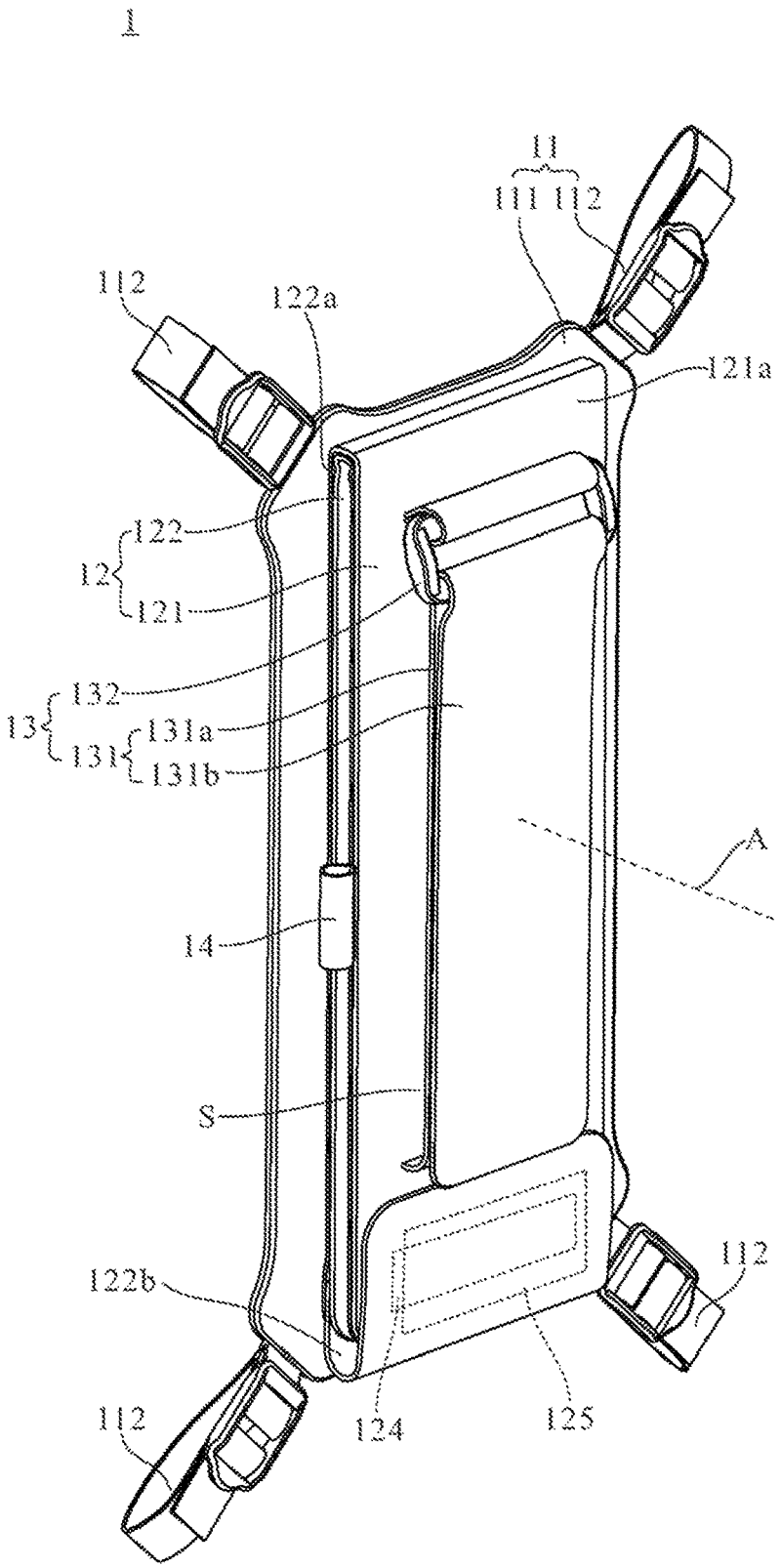
FIG. 1 is a perspective view of a hand strap according to the first embodiment of the present invention.
Figure 2:
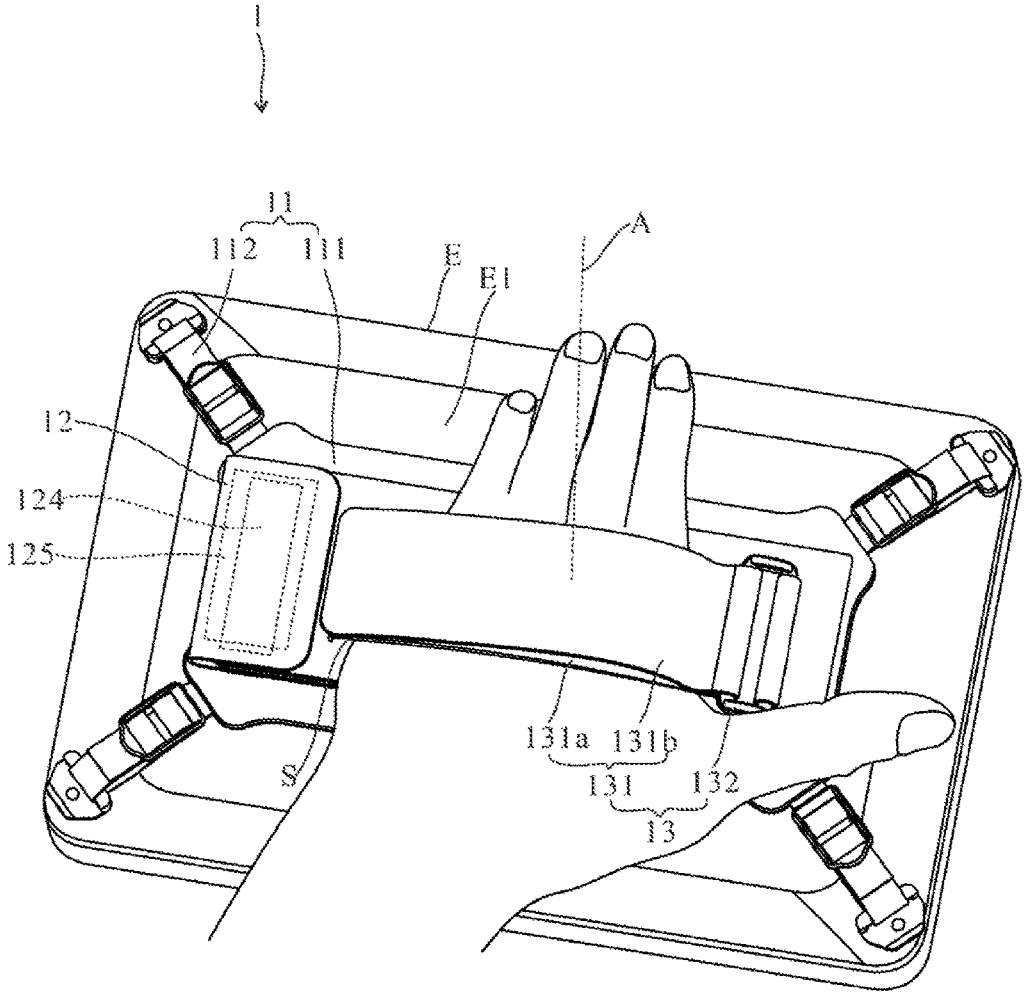
FIG. 2 is a perspective view of the hand strap mounted on a portable electronic device according to the first embodiment of the present invention.

Referring to FIG. 1 and FIG. 2, there are shown a perspective view of a hand strap 1 according to the first embodiment of the present invention and a perspective view of the hand strap 1 mounted on a portable electronic device E according to the first embodiment of the present invention, respectively. In this embodiment, the hand strap 1 is for use with the portable electronic device E, such as a tablet or a cellular phone, and comprises a fastening portion 11, a supporting portion 12, and a gripping portion 13. The fastening portion 11 is disposed on a rear surface E1 of the portable electronic device E, whereas the supporting portion 12 is disposed on the fastening portion 11, thereby allowing the hand strap 1 to be selectively unfolded and thus adapted to support the portable electronic device E. With the gripping portion 13 being disposed on the supporting portion 12, the user can manually grip the gripping portion 13 and hold the portable electronic device E in operation. Components of the hand strap 1 are hereunder described in terms of their structural features and relationship.

The fastening portion 11 has a central connecting element 111 and connecting cords 112. The connecting cords 112 are each extended from the central connecting element 111 (as shown in FIG. 2) and fastened to the rear surface E1 of the portable electronic device E; hence, the hand strap 1 can be disposed on the portable electronic device E.

Figure 5:
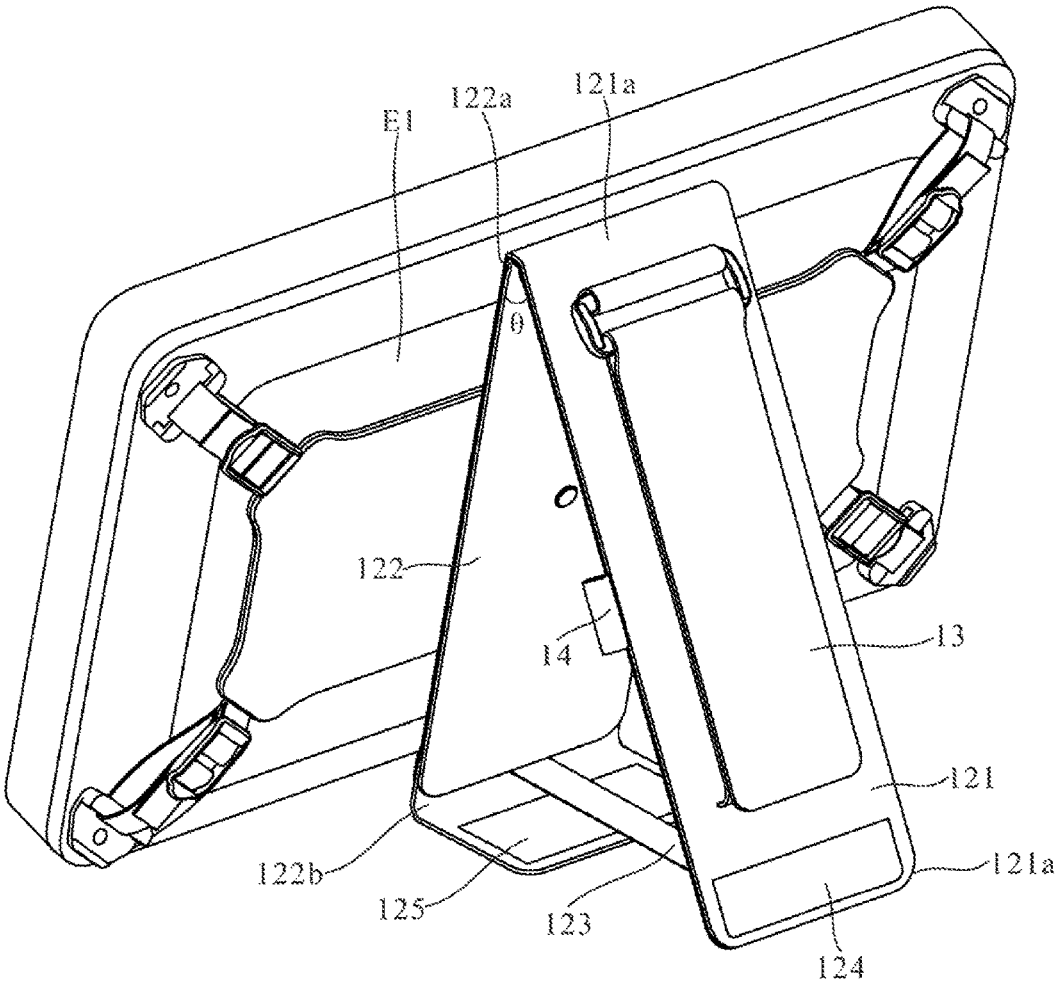
FIG. 5 is a perspective view of the hand strap in the unfolded state thereof according to the first embodiment of the present invention.

The supporting portion 12 has a first supporting element 121, a second supporting element 122, a positioning element 123, a first engaging structure 124 and a second engaging structure 125. In this embodiment, for the sake of illustration of how the supporting portion 12 rotates, an axis A is defined as being perpendicular to the rear surface E1 of the portable electronic device E. The second supporting element 122 is rotatably pivotally connected to the central connecting element 111 about the axis A. An end 121*a* of the first supporting element 121 is connected to one end 122*a* of the second supporting element 122, whereas the positioning element 123 is connected between the first supporting element 121 and the second supporting element 122, as shown in FIG. 5. In this embodiment, the first engaging structure 124 is formed on the first supporting element 121, and the second engaging structure 125 extends from the other end 122*b* of the second supporting element 122.

Figure 4:
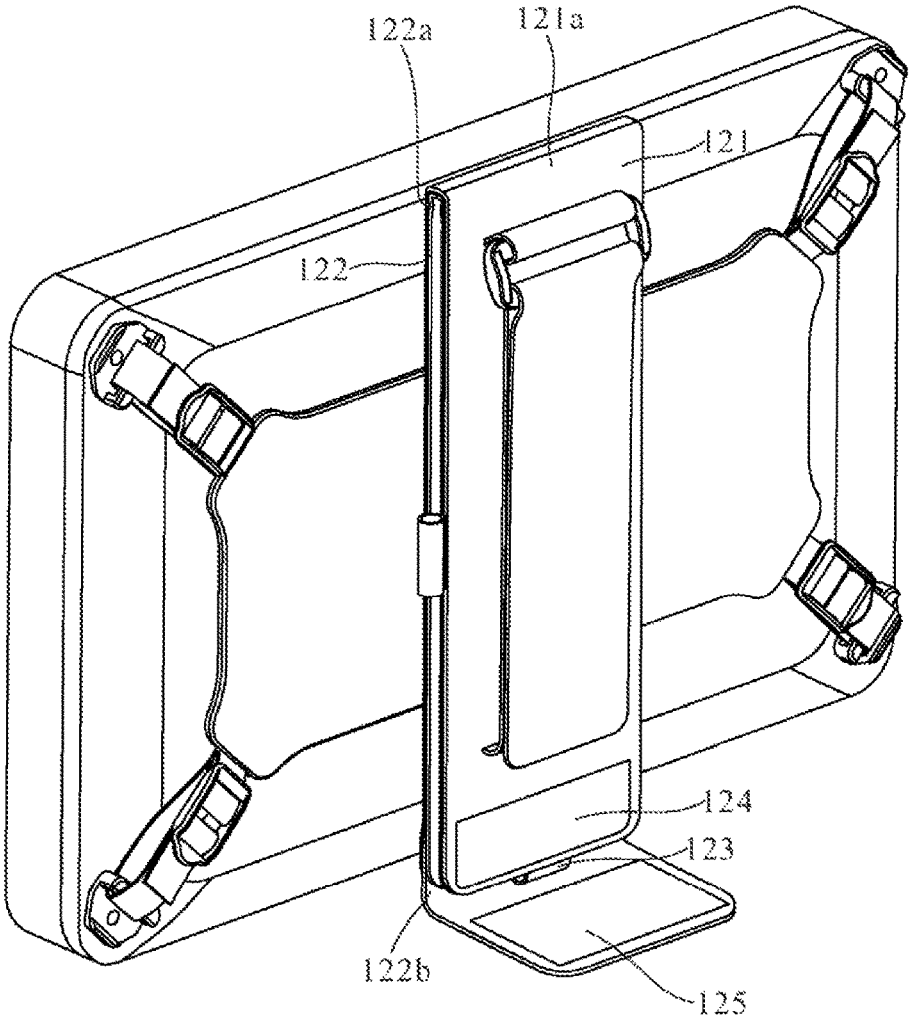
FIG. 4 is a perspective view of the hand strap before an unfolded state thereof according to the first embodiment of the present invention.

Referring to FIG. 1, in a folded state, the second engaging structure 125 covers the first engaging structure 124 to not only allow the first supporting element 121 and the second supporting element 122 to overlap exactly, but also allow the positioning element 123 to be retractedly positioned between the first supporting element 121 and the second supporting element 122, as shown in FIG. 4. In this embodiment, the central connecting element 111, the first supporting element 121, and the second supporting element 122 are each a plate, and thus in the folded state the central connecting element 111, the first supporting element 121, the second supporting element 122, and the rear surface E1 are substantially parallel.

Figure 3:
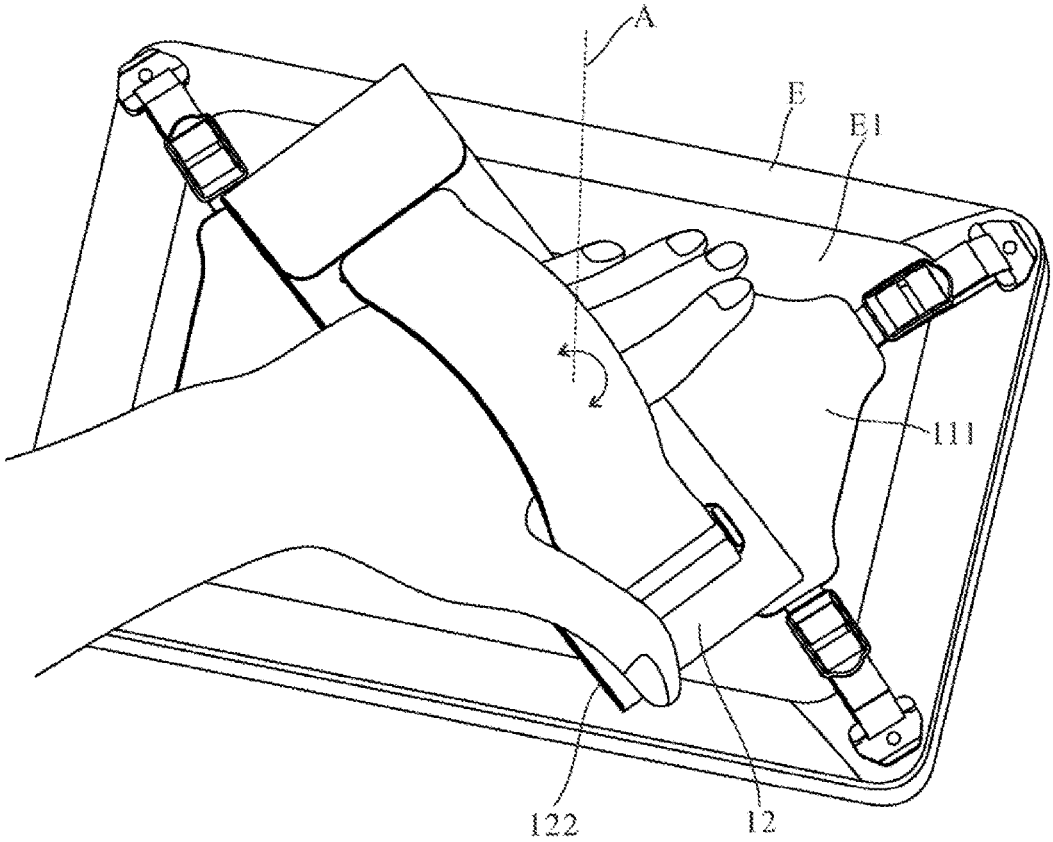
FIG. 3 is another perspective view of the hand strap mounted on the portable electronic device according to the first embodiment of the present invention.

Referring to FIG. 2 and FIG. 3, there is shown in FIG. 3 another perspective view of the hand strap according to the first embodiment of the present invention. The gripping portion 13 is disposed on the first supporting element 121 and has an elastic adjustable band 131 and a ring 132. After penetrating the ring 132, the elastic adjustable band 131 is divided into a first portion 131*a* and a second portion 131*b*. The first portion 131*a* and the second portion 131*b* adjoin each other. The first portion 131*a* and the first supporting element 121 jointly define a hand receiving space S. The user's hand inserted into the hand receiving space S is covered by the first portion 131*a* up to an appropriate length thereof in accordance with the width and thickness of the user's hand, as the lengths of the first portion 131*a* and second portion 131*b* are adjusted by the ring 132. Therefore, the user can hold the portable electronic device E in operation by hand with the gripping portion 13.

Referring to FIG. 3, after gripping the hand strap 1, the user rotates the portable electronic device E relative to the second supporting element 122 about the axis A while keeping the second supporting element 122, the central connecting element 111 and the rear surface E1 parallel, thereby allowing the first supporting element to attain a tilt angle conducive to operation.

Referring to FIG. 4, prior to an unfolded state, the hand strap 1 will be ready for use, only if the second engaging structure 125 and the first engaging structure 124 separate. Referring to FIG. 5, there is shown a perspective view of the hand strap 1 in the unfolded state thereof according to the first embodiment of the present invention. The first supporting element 121 rotates, with the end 122*a* serving as a fulcrum, by an angle θ to move away from the second supporting element 122. The positioning element 123 is extendedly connected between the first supporting element 121 and the second supporting element 122, and the second engaging structure 125 is disposed below the positioning element 123, thereby allowing the first supporting element 121 to tilt relative to the second supporting element 122 by the angle θ. Furthermore, the first supporting element 121 is restrained by the positioning element 123 and thus positioned in place. Hence, the first supporting element 121, the second supporting element 122 and the positioning element 123 jointly form a triangular support whereby the portable electronic device E stands on any desktop or working surface when supported by the supporting portion 12.

In a variant embodiment of the present invention, the length of the positioning element 123 is adjusted according to the size, weight and the like of the portable electronic device E so that the first supporting element 121 tilts relative to the second supporting element 122 by the maximum angle θ. In this embodiment, the hand strap 1 further comprises a pen case 14 disposed beside the first supporting element 121 and positioned proximate to the gripping portion 13. If the portable electronic device E comprises a stylus, the user can choose to place the stylus in the pen case 14, allowing the user to take the stylus directly by hand while gripping the gripping portion 13. The first engaging structure 124 and the second engaging structure 125 together form a hook-and-loop fastener in this embodiment, but are coupled together in the other ways in variant embodiments of the present invention.

Figure 6:
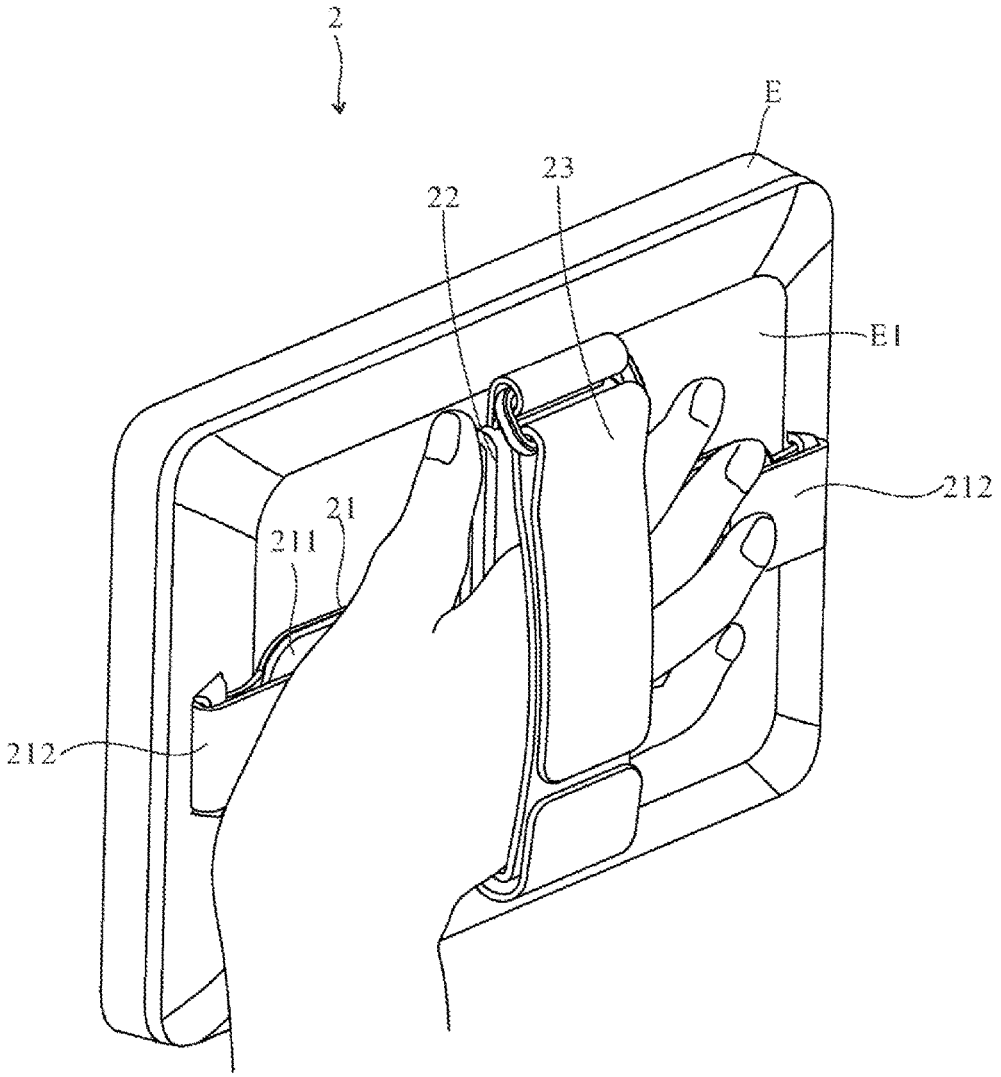
FIG. 6 is a perspective view of the hand strap coupled to the portable electronic device according to the second embodiment of the present invention.
Figure 7:
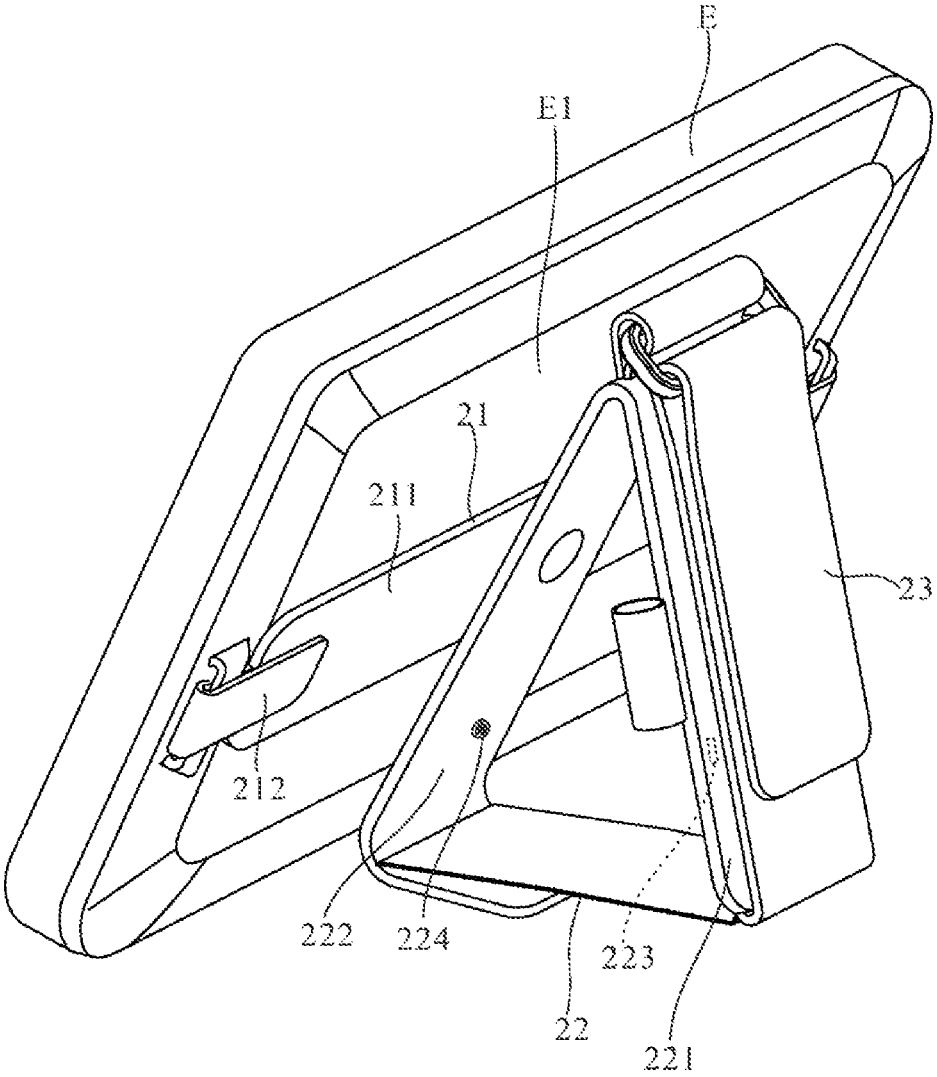
FIG. 7 is a perspective view of the hand strap in the unfolded state thereof according to the second embodiment of the present invention.

Referring to FIG. 6 and FIG. 7, there are shown a perspective view of a hand strap 2 in the folded state thereof according to the second embodiment of the present invention and a perspective view of the hand strap 2 in the unfolded state thereof according to the second embodiment of the present invention, respectively. In this embodiment, the hand strap 2 comprises a fastening portion 21, a supporting portion 22 and a gripping portion 23. The fastening portion 21 is disposed on the rear surface E1 of the portable electronic device E. In the folded state, the gripping portion 23 is conducive to the user's grip on the portable electronic device E. In the unfolded state, the supporting portion 22 supports the portable electronic device E and thus enables the portable electronic device E to stand. The second embodiment differs from the first embodiment in that in the second embodiment the connecting cords 212 of the fastening portion 21 are extended from two ends of a central connecting element 211 and fastened to the rear surface E1 of the portable electronic device E. In this embodiment, a first engaging structure 223 (indicated by the dashed line of FIG. 7) and a second engaging structure 224 of the supporting portion 22 are two fasteners and form a first supporting element 221 and a second supporting element 222 opposing the first supporting element 221, respectively. In the folded state, the first engaging structure 223 and the second engaging structure 224 are engaged with each other so that the first supporting element 221 and the second supporting element 222 overlap.

In conclusion, after a hand strap of the present invention has been placed on a rear surface of a portable electronic device, the hand strap in a folded state assists a user in holding the portable electronic device by hand firmly and in an unfolded state gives sufficient support to the portable electronic device, thereby allowing the portable electronic device to be placed on any working surface and stand thereon. With the hand strap being capable of serving a gripping purpose and a supporting function simultaneously, not only does the user fold and unfold the hand strap as needed quickly and conveniently, but the quantity of accessories of the portable electronic device is also reduced.

The aforesaid embodiments illustrate the implemented aspects of the present invention and explain the technical features of the present invention rather than restrict the claims of the present invention. All changes and equivalent arrangements readily made to the embodiments of the present invention by persons skilled in the art shall be deemed falling into the scope of the appended claims. Accordingly, the legal protection for the present invention should be defined by the appended claims.

What is claimed is:

1. A hand strap for use with a portable electronic device, the hand strap comprising:

a fastening portion fastened to a rear surface of the portable electronic device;

a supporting portion having a first supporting element and a second supporting element, wherein the second supporting element is rotatably pivotally connected to the fastening portion about an axis perpendicular to the rear surface, and an end of the first supporting element is connected to an end of the second supporting element; and a gripping portion disposed on the first supporting element, wherein the first supporting element and the second supporting element overlap and contact each other in a folded state such that the first supporting element covers the second supporting element, and the first supporting element tilts relative to the second supporting element by an angle in an unfolded state, thereby allowing the supporting portion to support the portable electronic device.

2. The hand strap of claim 1, wherein the supporting portion further has a positioning element connected between the first supporting element and the second supporting element, retractable between the first supporting element and the second supporting element in the folded state, and extended between the first supporting element and the second supporting element in the unfolded state, thereby allowing the first supporting element to tilt relative to the second supporting element by the angle.

3. The hand strap of claim 2, wherein the first supporting element has a first engaging structure, and the second supporting element has a second engaging structure, coupling the first engaging structure and the second engaging structure together in the folded state, and separating the second engaging structure and the first engaging structure in the unfolded state.

4. The hand strap of claim 3, wherein the fastening portion has a central connecting element and connecting cords, with the connecting cords each extended from the central connecting element and fastened to the rear surface of the portable electronic device, and the second supporting element being pivotally connected to the central connecting element.

5. The hand strap of claim 4, wherein the gripping portion has an elastic adjustable band and a ring so that, after penetrating the ring, the elastic adjustable band is divided into a first portion and a second portion adjoining the first portion, with the ring being capable of adjusting lengths of the first portion and the second portion, respectively, thereby allowing the first portion and the first supporting element to jointly define a hand receiving space.

6. The hand strap of claim 5, wherein the central connecting element, the first supporting element, and the second supporting element are each a plate, and thus in the folded state the central connecting element, the first supporting element, the second supporting element, and the rear surface are parallel.

7. The hand strap of claim 6, further comprising a pen case disposed beside the first supporting element.

8. The hand strap of claim 3, wherein the first engaging structure and the second engaging structure are each a fastener whereby in the folded state the first engaging structure and the second engaging structure are fastened to each other.

9. The hand strap of claim 3, wherein the first engaging structure is formed at another end of the first supporting element, whereas the second engaging structure extends from another end of the second supporting element to cover the another end of the first supporting element and thereby engage with the first engaging structure in the folded state and is positioned below the positioning element in the unfolded state.

10. The hand strap of claim 4, wherein the connecting cords are extended from two ends of the central connecting element and fastened to the portable electronic device.

11. The hand strap of claim 4, wherein the connecting cords are extended from four corners of the central connecting element and fastened to the portable electronic device.

12. A hand strap for use with a portable electronic device, the hand strap comprising:

a fastening portion fastened to a rear surface of the portable electronic device;

a supporting portion having a first supporting element and a second supporting element, wherein the second supporting element is rotatably pivotally connected to the fastening portion about an axis perpendicular to the rear surface, and an end of the first supporting element is connected to an end of the second supporting element, wherein the first supporting element and the second supporting element are integrally formed; and a gripping portion disposed on the first supporting element, wherein the first supporting element and the second supporting element overlap in a folded state, and the first supporting element tilts relative to the second supporting element by an angle in an unfolded state, thereby allowing the supporting portion to support the portable electronic device.

* * * * *